US011679958B2

(12) United States Patent
Laine et al.

(10) Patent No.: US 11,679,958 B2
(45) Date of Patent: Jun. 20, 2023

(54) SAFETY GEAR ARRANGEMENT, ELEVATOR SYSTEM, AND METHOD FOR OPERATING A SAFETY GEAR OF AN ELEVATOR SYSTEM

(71) Applicant: Kone Corporation, Helsinki (FI)

(72) Inventors: Janne Laine, Helsinki (FI); Veijo Manninen, Helsinki (FI); Tuukka Korhonen, Helsinki (FI); Matti Rasanen, Helsinki (FI); Jorma Mustalahti, Helsinki (FI); Ville Myyrylainen, Helsinki (FI); Tarvo Viita-Aho, Helsinki (FI); Henri Wenlin, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 17/357,165

(22) Filed: Jun. 24, 2021

(65) Prior Publication Data

US 2022/0002115 A1 Jan. 6, 2022

(30) Foreign Application Priority Data

Jul. 1, 2020 (EP) ..... 20183336

(51) Int. Cl.
*B66B 5/22* (2006.01)

(52) U.S. Cl.
CPC ..... *B66B 5/22* (2013.01)

(58) Field of Classification Search
CPC ..... B66B 5/22
See application file for complete search history.

(56) References Cited

FOREIGN PATENT DOCUMENTS

| | | | | |
|---|---|---|---|---|
| DE | 202019101479 U1 | | 6/2020 | |
| EP | 3549896 A1 | | 10/2019 | |
| EP | 3670414 A1 | | 6/2020 | |
| WO | WO-2008149413 A1 | * | 12/2008 | ..... B66B 5/20 |
| WO | WO-2019/220505 A1 | | 11/2019 | |

OTHER PUBLICATIONS

Machine translation of WO 2008/149413.*
European Search Report dated Dec. 14, 2020 for corresponding European Application No. 20183336.5.
Response to European Communication and European Search Report dated Jun. 14, 2022 for European Application No. 20183336.5.

* cited by examiner

*Primary Examiner* — Diem M Tran
(74) *Attorney, Agent, or Firm* — Harness, Dickey & Pierce, P.L.C.

(57) ABSTRACT

A safety gear arrangement for an elevator system, comprising a safety gear mechanism comprising at least one wedge portion of the safety gear arrangement, wherein, in a normal position, the at least one wedge portion is retracted and, in an operated position, extended by a first spring element for acting on a guide rail of the elevator system, and a triggering device comprising an electromagnet, a second spring element, an actuating member, and an excitation power input, wherein the electromagnet is arranged, while being supplied with excitation power, to maintain the actuating member in an untriggered position against the second spring element, and the actuating member is arranged to operate the safety gear mechanism in response to moving of the member from the untriggered to a triggered position due to the second spring element.

13 Claims, 10 Drawing Sheets

SAFETY GEAR ARRANGEMENT, ELEVATOR SYSTEM, AND METHOD FOR OPERATING A SAFETY GEAR OF AN ELEVATOR SYSTEM

RELATED APPLICATIONS

This application claims priority to European Patent Application No. 20183336.5 filed on Jul. 1, 2020, the entire contents of which are incorporated herein by reference.

FIELD OF THE INVENTION

The present invention relates in general to elevators. In particular, however not exclusively, the present invention concerns safety gears of elevators.

BACKGROUND

Typical elevators are equipped with safety gears. An elevator safety gear is a safety protection device. Elevator safety gear is typically operated by an overspeed governor of the elevator. The function of the safety gear is to decelerate, stop and hold the elevator car in contact with the elevator guide rail in an emergency situation when the speed of an elevator car has exceeded the set speed by elevator overspeed governor.

In known attempts, the overspeed governor, which have long governor ropes, is operated mechanically, which makes them complex. Furthermore, it can be difficult the detach the elevator car after operation of the safety gear.

SUMMARY

An objective of the present invention is to provide a safety gear arrangement, an elevator system, and a method for operating a safety gear of an elevator system. Another objective of the present invention is that the safety gear arrangement, the elevator system, and the method provide a solution which is efficient and can be simple and compact in structure.

The objectives of the invention are reached by a safety gear arrangement, an elevator system, and a method for operating a safety gear of an elevator system as defined by the respective independent claims.

According to a first aspect, a safety gear arrangement for an elevator system is provided. The safety gear arrangement comprises a safety gear mechanism comprising at least one wedge portion of the safety gear arrangement, wherein, in a normal position, the at least one wedge portion is retracted and, in an operated position, extended by a first spring element, such as a torsion spring element, for acting on a guide rail of the elevator system. Furthermore, the safety gear arrangement comprises a triggering device comprising an electromagnet, a second spring element, such as a compression spring element, an actuating member, and an excitation power input, wherein the electromagnet is arranged, while being supplied with excitation power via the excitation power input, to maintain the actuating member in an untriggered position against the second spring element. Still further, the safety gear arrangement comprises the actuating member is arranged to operate the safety gear mechanism in response to moving of the actuating member from the untriggered position to a triggered position due to the second spring element.

In various embodiments, the safety gear mechanism may comprise a locking mechanism in operative coupling with the actuating member, wherein the locking mechanism is arranged to maintain the safety gear mechanism in the normal position when the actuating member is in the untriggered position, and to release the safety gear mechanism when actuating member is in the triggered position so that the first spring element causes the moving of the at least one wedge portion. Additionally, optionally, the safety gear mechanism may comprise at least one first support member operatively, such as mechanically, coupling the locking mechanism and the wedge portion.

In some embodiments, the safety gear mechanism may comprise two wedge portions, wherein, in the normal position, the wedge portions are retracted and, in the operated position, extended for acting on the guide rail of the elevator system. Optionally, in addition, the safety gear mechanism may comprise two first support members operatively, such as mechanically, coupling the locking mechanism and the wedge portions, respectively.

Alternatively or in addition, the first support members are operatively coupled by a joint with respect to each other.

In various embodiments, the safety gear arrangement may comprise a linear motor, such as being a part of the safety gear mechanism, wherein the linear motor is arranged to move the safety gear mechanism from the operated position to the normal position. In addition, optionally, the triggering device may be arranged to move from the triggered position to the untriggered position in response to the movement of the safety gear arrangement from the operated position to the normal position.

In various embodiments, in the untriggered position, the actuating member and the electromagnet are in direct contact.

Furthermore, the safety gear arrangement may comprise at least one third support member operatively, such as mechanically, coupling the actuating member and the linear motor.

In various embodiments, the locking mechanism may be arranged to lock the safety gear mechanism in response to moving of the safety gear mechanism from the operated position into the normal position.

Furthermore, the safety gear arrangement may comprise two safety gear mechanisms, wherein a first safety gear mechanism comprises the at least one wedge portion for acting on one guide rail of the elevator system, and wherein a second safety gear mechanism comprises at least one second wedge portion of the safety gear arrangement for acting on another guide rail of the elevator system, wherein the safety gear arrangement further comprises the triggering device arranged to operate the two safety gear mechanisms in response to moving of the actuating member from the untriggered position to the triggered position due to the second spring element. In addition, optionally, the two safety gear mechanisms may be coupled mechanically with the triggering device by a fourth support member, such as a bar.

According to a second aspect, an elevator system is provided. The elevator system comprises an elevator car movable in an elevator shaft, and a safety gear arrangement according to the first aspect being mounted on the elevator car.

According to a third aspect, a method for operating a safety gear of an elevator system is provided. The method comprises:

providing excitation power via an excitation power input to an electromagnet of a triggering device in operative coupling with the safety gear to maintain the safety gear in a normal position, and interrupting the excitation power for moving of an actuating member of the triggering device from the untriggered position to a triggered position due to the second spring element of the triggering device for operating the safety gear.

The present invention provides a safety gear arrangement, an elevator system, and a method for operating a safety gear of an elevator system. The present invention provides advantages over known solutions that the structure of the safety gear arrangement is simpler and compact, there is no need for the long ropes of the overspeed governor since the control is implemented by the electrical triggering device. The triggering device is efficient since the electromagnet requires small amount of energy to maintain the safety gear arrangement in its normal position. In accordance with some of the embodiments, the detachment of the wedges from the guide rail is easier than in the known attempts due to the linear motor.

Various other advantages will become clear to a skilled person based on the following detailed description.

The terms "first", "second", etc. are herein used to distinguish one element from other element, and not to specially prioritize or order them, if not otherwise explicitly stated.

The exemplary embodiments of the present invention presented herein are not to be interpreted to pose limitations to the applicability of the appended claims. The verb "to comprise" is used herein as an open limitation that does not exclude the existence of also unrecited features. The features recited in depending claims are mutually freely combinable unless otherwise explicitly stated.

The novel features which are considered as characteristic of the present invention are set forth in particular in the appended claims. The present invention itself, however, both as to its construction and its method of operation, together with additional objectives and advantages thereof, will be best understood from the following description of specific embodiments when read in connection with the accompanying drawings.

BRIEF DESCRIPTION OF FIGURES

Some embodiments of the invention are illustrated by way of example, and not by way of limitation, in the figures of the accompanying drawings.

DETAILED DESCRIPTION OF SOME EMBODIMENTS

Figure 1:
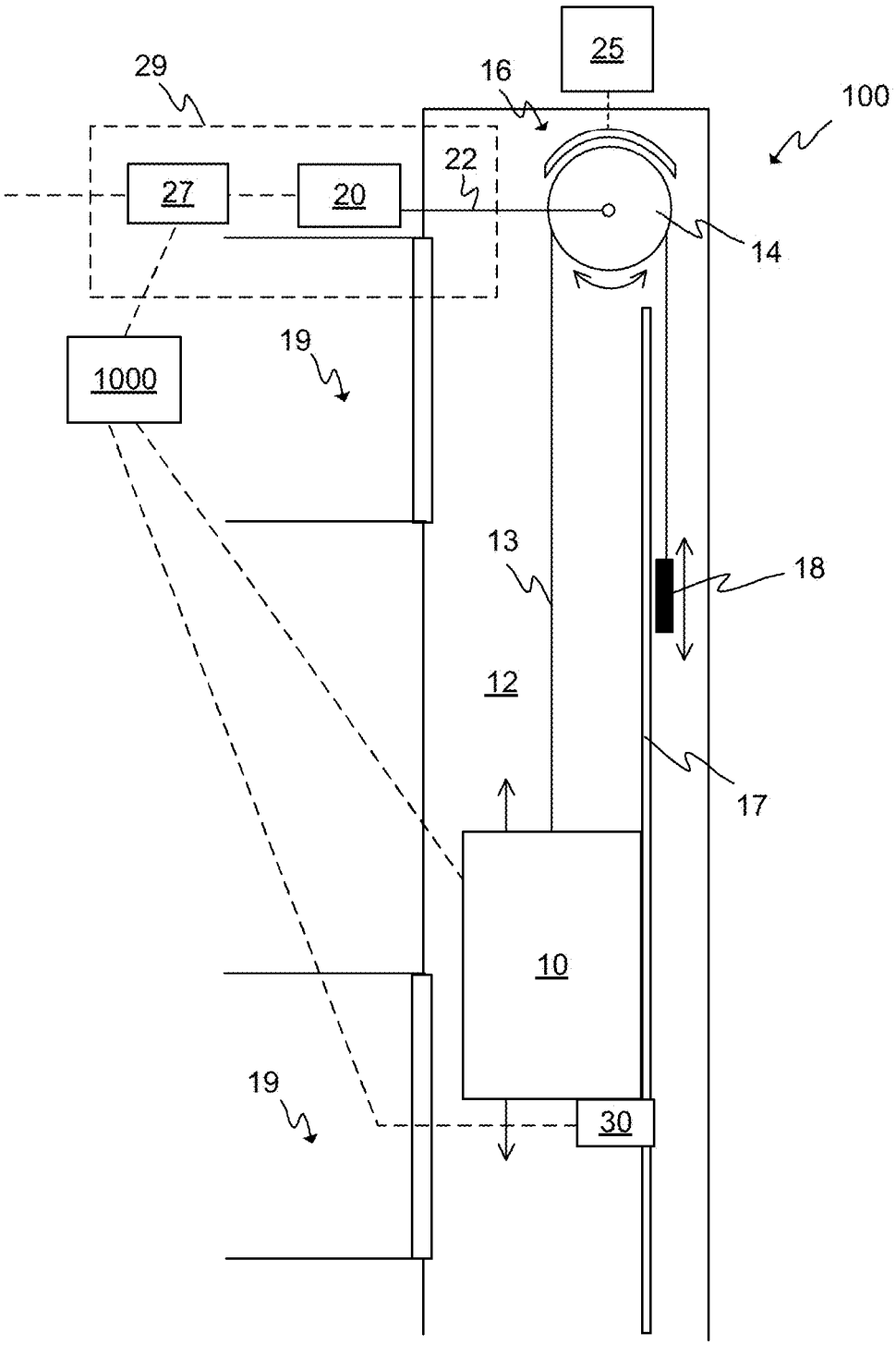
FIG. 1 illustrates schematically an elevator system according to an embodiment of the present invention.

FIG. 1 illustrates schematically an elevator system 100 according to an embodiment of the present invention. The elevator system 100, or as visible in the FIG. 1, an elevator 100 or one of the elevators of the system 100, such as of a group of elevators, may comprise an elevator car 10 arranged to be moved or movable in an elevator shaft 12. The moving of the elevator car 10 may be implemented, preferably, by a hoisting rope or belt 13 in connection with a traction sheave 14 or the like. Furthermore, the elevator system 100 may comprise a safety gear arrangement 30, such as arranged in connection on the elevator car 10, for example, to the bottom thereof, and configured to grip a guide rail 17 when being operated so as to decelerate, stop, and/or maintain the position of the elevator car 10.

The elevator 100 may preferably comprise landings 19 or landing floors and, for example, landing floor doors and/or openings, between which the elevator car 10 is arranged to be moved during the normal elevator operation, such as to move persons and/or items between said landings 19.

Furthermore, the elevator 100 may comprise an electric motor 20 arranged to operate, such as rotate by the rotor thereof, the traction sheave 14 for moving the elevator car 10, if not essentially directly coupled to the hoisting rope 13. The traction sheave 14 may be connected, via a mechanical connection 22, directly or indirectly via a gear to a shaft of the motor 20. The elevator 100 may comprise a machine room or be machine roomless, such as have the motor 20 in the elevator shaft 12.

The elevator 100 may preferably comprise at least one, or at least two, hoisting machinery brake(s) 16 configured for resisting or, preferably, preventing the movement of the motor 20, that is the rotor thereof, directly or via the traction sheave 14 or components thereof and/or therebetween. Furthermore, the elevator 100 may comprise a brake controller 25 configured to operate at least one of the at least one hoisting machinery brake 16. The brake controller 25 may further be in connection with other elements of the elevator 100, such as an elevator controller 1000. The brake controller 25 may comprise an actuator (not shown) for operating the brake 16 or at least be in connection with such an actuator.

Still further, the elevator 100 may additionally comprise the guide rail 17 or rails 17 arranged into the elevator shaft 12 for, for example, guiding the movement of the elevator car 10. The elevator car 10 may comprise guide shoes, rollers or the like in moving in contact with one or some of the guide rails 17.

There may additionally be, at least in some embodiments, a counterweight 18 arranged in connection with the elevator car 10 such as is known to a person skilled in the art of elevators.

The elevator system 100 may further comprise an elevator drive unit 29, such as comprising at least a converter unit 27, for example, a frequency converter, and preferably the elevator motor 20. The elevator drive unit 29, such as the converter unit 27 thereof, may comprise an input for receiving absolute position and/or speed information of an elevator car 10, such as from an encoder mounted to the elevator car 10 or to the elevator motor 20.

In various embodiments, the elevator 100 comprises an elevator control unit 1000 for controlling the operation of the elevator system 100. The elevator control unit 1000 may be arranged in communication connection with various subsystems and/or devices of the elevator system 1000, such as with the elevator car 10, the safety gear arrangement 50, the elevator drive unit 29, the brake controller 25, and/or landing doors, etc.

Figure 2A:
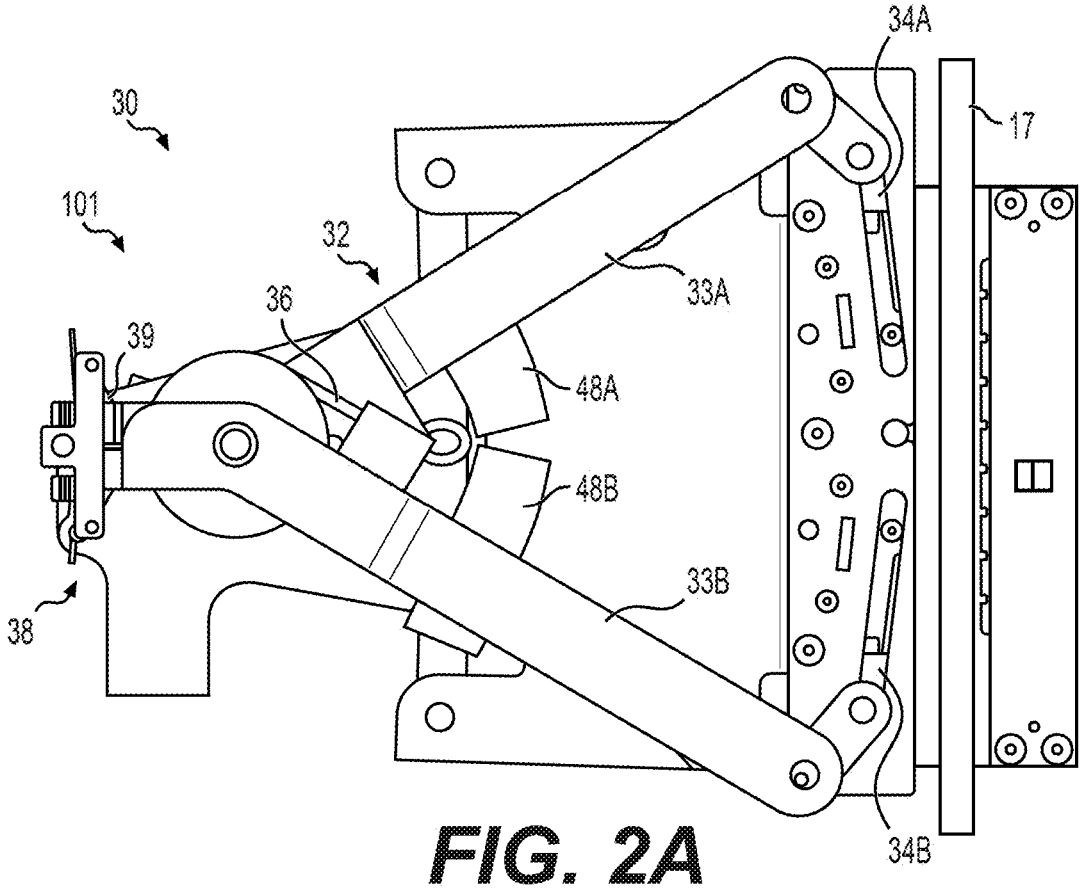
FIGS. 2A and 2B illustrate schematically a safety gear arrangement according to a first embodiment of the present invention in its normal position from opposite sides, that is from a first side and a second side, respectively.
Figure 2B:
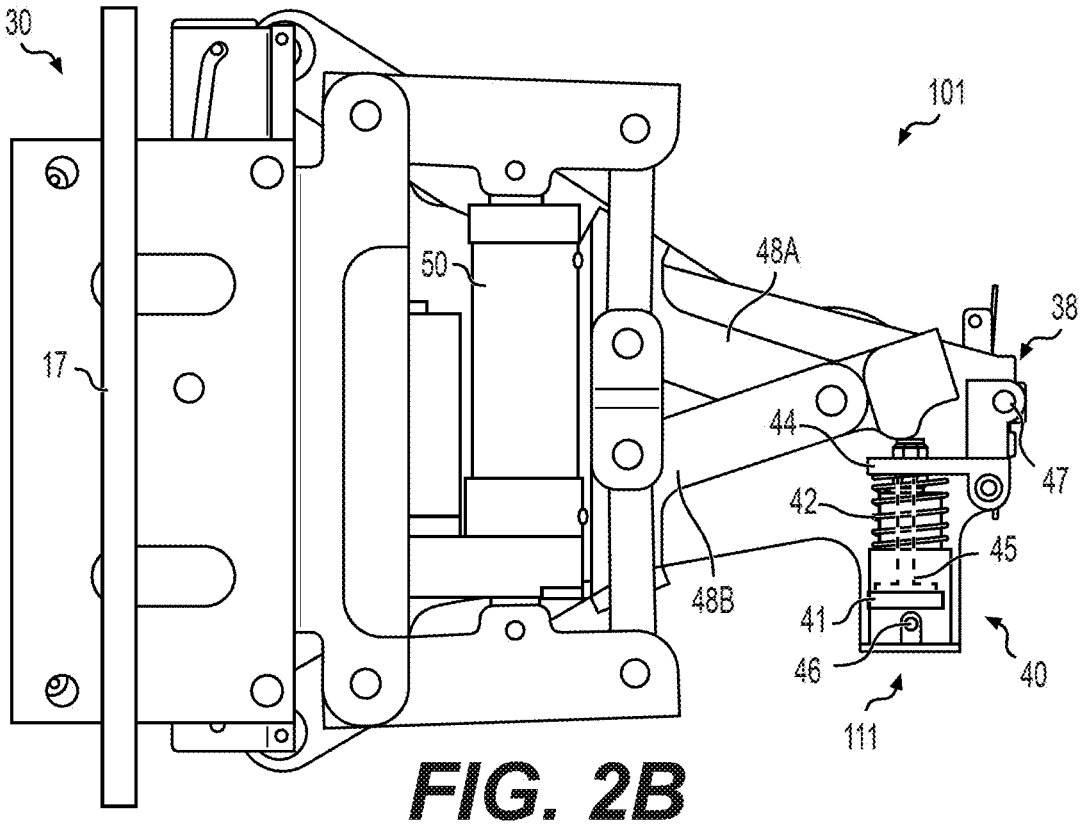

FIGS. 2A and 2B illustrate schematically a safety gear arrangement 30 according to a first embodiment of the present invention in its normal position from opposite sides, that is from the first side and the second side, respectively. The safety gear arrangement 30 may comprise a safety gear mechanism 32 comprising at least one wedge portion 34A, 34B of the safety gear arrangement 30, wherein, in a normal position 101, the at least one wedge portion 34A, 34B is retracted and, in an operated position 102 (not shown in FIGS. 2A and 2B), extended by a first spring element 36, such as a torsion spring element, for acting on a guide rail 17 of the elevator system 100. Although shown in FIGS. 2A and 2B that there are two wedge portions 34A, 34B, in some embodiments, there could only be one wedge portion 34A, 34B or more than two wedge portions 34A, 34B.

Furthermore, regarding FIG. 2B, the safety gear arrangement 30 may comprise a triggering device 40 comprising an electromagnet 41, such as arranged inside the body 45 of the device 40, a second spring element 42, such as a compression spring element, an actuating member 44 (the portion extending inside the body 45 is shown with dashed lines), and an excitation power input 46, wherein the electromagnet 41 is arranged, while being supplied with excitation power via the excitation power input 46, to maintain the actuating member 44 in an untriggered position 111 against the second spring element 42. The actuating member 44 may be arranged to operate the safety gear mechanism 32 in response to moving of the actuating member 44 from the untriggered position 111 to a triggered position (not shown in FIGS. 2A and 2B) due to the second spring element 42, such as when the excitation power is being cut off or interrupted. This will cause the at least one wedge portion 34 to move to its operated position 102, and thereby, if the safety gear arrangement 30 has been arranged to an elevator system 100 appropriately and configured for operation, towards the guide rail 17 or other gripping surface. The safety gear arrangement 30 may further comprise a frame to which at least some of its components may be mounted (that is, at least those requiring said mounting) and by which the arrangement 30 may be mounted to the elevator car 10.

In various embodiments, the actuating member 44 may comprise a single part or be comprised of several parts which are mechanically connected to each other. In FIG. 2B, for example, the actuating member 44 comprises essentially two parts, the one mostly inside the body 45, such as a spindle or shaft, and the horizontal element to which the part mostly inside the body 45 is attached to. Thus, the second spring element 42 may also be arranged to apply force on the actuating member 44, such as to said horizontal element in FIG. 2B which may be part of the actuating member 44. It is to be noted, however, that the actuating member 44 could also be made essentially of a single part.

In various embodiments, the elevator system 100, or specifically the safety gear arrangement 30, may comprise a further braking surface(s) or element(s) arranged on opposite side of the guide rail 17 so that the wedges mounted on the wedge portions 34 squeeze the guide rail 17 therebetween in order to decelerate the elevator car 10.

In addition, the safety gear arrangement 30 may comprise a locking mechanism 38 in operatively, preferably mechanically, coupling with the actuating member 44, wherein the locking mechanism 38 is arranged to maintain the safety gear mechanism 32 in the normal position 101 when the actuating member 44 is in the untriggered position 111, and to release the safety gear mechanism 32 when actuating member 44 is in the triggered position so that the first spring element 36 causes the moving of the at least one wedge portion 34A, 34B. The locking mechanism 38 may comprise a locking member(s) 39, for example, including flanges or "claws" therein as shown in FIG. 2A, to maintain the safety gear arrangement 30 in the normal position 101.

In some embodiments, the safety gear mechanism 32 may comprise at least one first support member 33A, 33B mechanically coupling the locking mechanism 38 and the wedge portion 34A, 34B.

Alternatively or in addition, the safety gear mechanism 32 may comprise two wedge portions 34A, 34B, such as shown in FIGS. 2A and 2B, wherein, in the normal position 101, the wedge portions 34A, 34B are retracted and, in the operated position 102, extended for acting, for example, on the guide rail 17 of the elevator system 100. Optionally, the safety gear mechanism 30 may, in addition, comprise one of the first support members 33A mechanically coupling the locking mechanism 38 and one of the wedge portions 34A, and other one of the first support members 33B mechanically coupling the locking mechanism 38 and other one of the wedge portions 34B.

Still further, the safety gear mechanism 32 may comprise the first support members 33A, 33B operatively coupled by a joint with respect to each other.

Furthermore, alternatively or in addition, the first support member(s) 33A, 33B may extend between the locking mechanism 38 and one of the wedge portion(s) 34A, 34B. Thus, the first support member(s) 33A, 33B may be a one-piece element or elements or, alternatively, may be comprised of a plurality of elements, such as will be illustrated in FIG. 15.

In various embodiments, such as shown in FIG. 2B, the safety gear arrangement 30 may comprise a motor, such as a linear motor 50, wherein the linear motor 50 is arranged to move the safety gear mechanism 30 from the operated position 102 to the normal position 101. Furthermore, the triggering device 40 may be arranged to move from the triggered position to the untriggered position 111 in response to the movement of the safety gear mechanism 32 from the operated position 102 to the normal position 101.

In some embodiments, such as shown in FIGS. 2A and 2B, in the untriggered position 111, the actuating member 44 and the electromagnet 41 are in direct contact with each other, such as there is no air gap between them. This is visible in FIG. 2B in which the portion of the actuating member 44 inside the body 45 is essentially in contact with the electromagnet 41. It is clear, however, there may also be intermediate layers arranged between the actuating member 44 and the electromagnet 41, such as of magnetic material. Thus, the electromagnet 41 can be utilized to maintain the actuating member 44 in its untriggered position 111 against the force of the second spring element 42. In various embodiments, the electromagnet 41 may, advantageously, be designed, such as dimensioned, so that it can generate enough force to maintain the actuating member 44 in its position, however, not necessarily able to move the actuating member 44 from the triggered position to the untriggered position 111.

Optionally, there may be a second support member 47 mechanically coupling the actuating member 44 and the locking mechanism 38 to each other. In FIG. 2B, this may be an axis of a joint connecting the locking mechanism 38 and the actuating member 44.

In some embodiments, the safety gear arrangement 30 may comprise at least one third support member 48A, 48B coupled operatively, preferably mechanically, or at least be involved in the mechanical coupling of, the actuating member 44 and the linear motor 50. By said operative, preferably mechanical coupling, the actuating member 44 is configured to be moved to the untriggered position 111. Thus, said operatively, preferably mechanically, coupling does not necessarily, as will be shown, exist in all positions of the safety gear arrangement 30.

In various embodiments, the locking mechanism 38 may arranged to lock the safety gear mechanism 32 in response to moving of the safety gear mechanism 32 from the operated position 102 into the normal position 101. In embodiments in accordance with FIG. 2B, for example, this is implemented so that the linear motor 50 moves the third support member(s) 48A, 48B which, as better shown in FIG. 2A, move the first support members 33A, 33B away from each other with a gripping portion(s) thereof, such as a flange(s), and then by also moving the actuating member 44, arranges the locking mechanism 38 to lock the safety gear mechanism 32. This will be described in more detail hereinafter.

Figure 3:
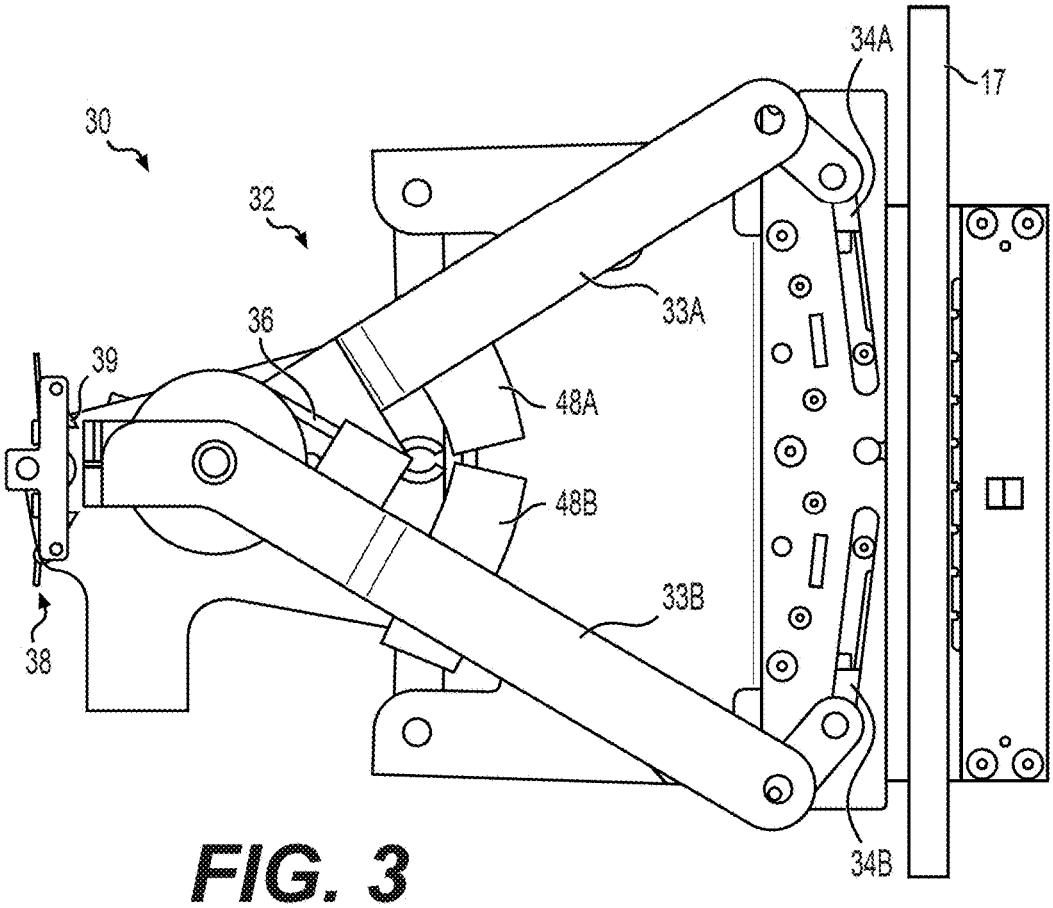
FIG. 3 illustrates schematically the safety gear arrangement according to the first embodiment of the present invention from the first side, wherein the actuating member is in its triggered position.

FIG. 3 illustrates schematically the safety gear arrangement 30 according to the first embodiment of the present invention from the first side, wherein the actuating member is in its triggered position. Thus, the actuating member 44 has been moved by the force of the second spring element 42, thereby operating the locking mechanism 38 to release the first support members 33A, 33B, in this case, the ends thereof. FIG. 3 illustrates the moment in which the locking mechanism 38 has released the first support members 33A, 33B, however, due to inertia, the force of the first spring element 36 has not yet moved the first support member 33A, 33B.

Figure 4:
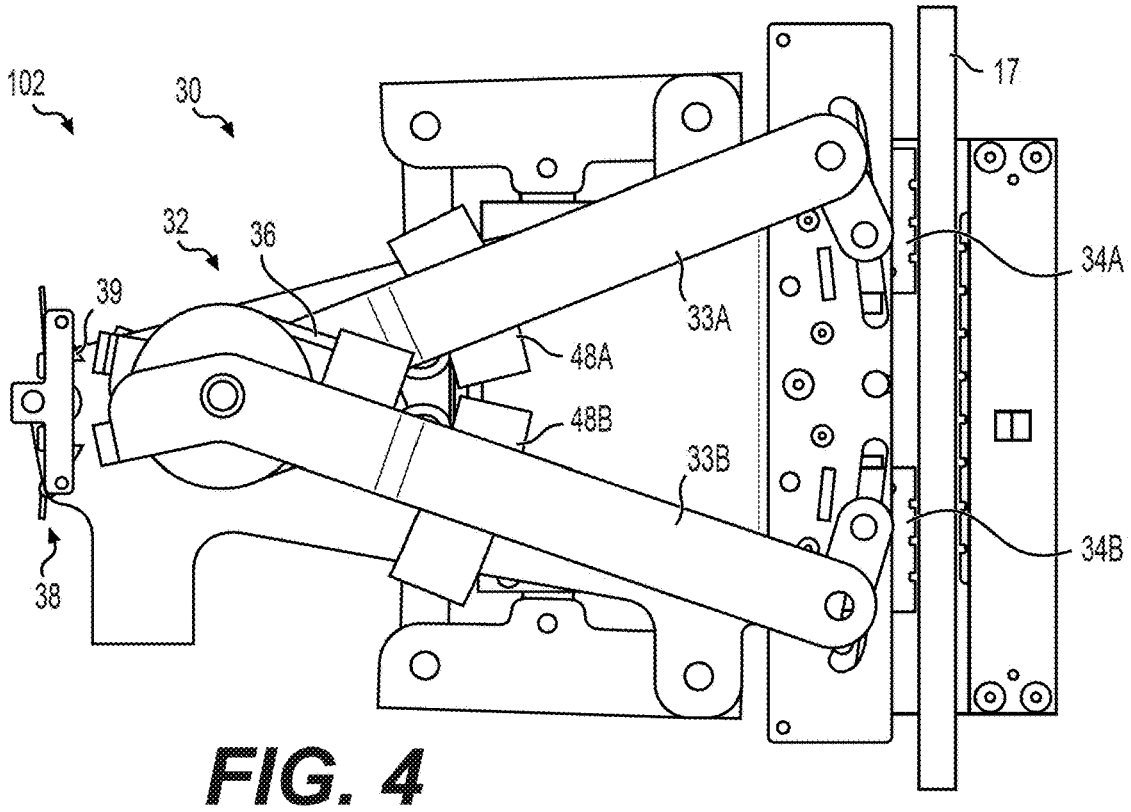
FIG. 4 illustrates schematically the safety gear arrangement according to the first embodiment of the present invention in its operated position from the first side.

FIG. 4 illustrates schematically the safety gear arrangement 30 according to the first embodiment of the present invention in its operated position 102 from the first side. As can be seen, the wedge portions 34 are extended by a first spring element 36, such as a torsion spring element, for acting on the guide rail 17 of the elevator system 100.

Figure 5:
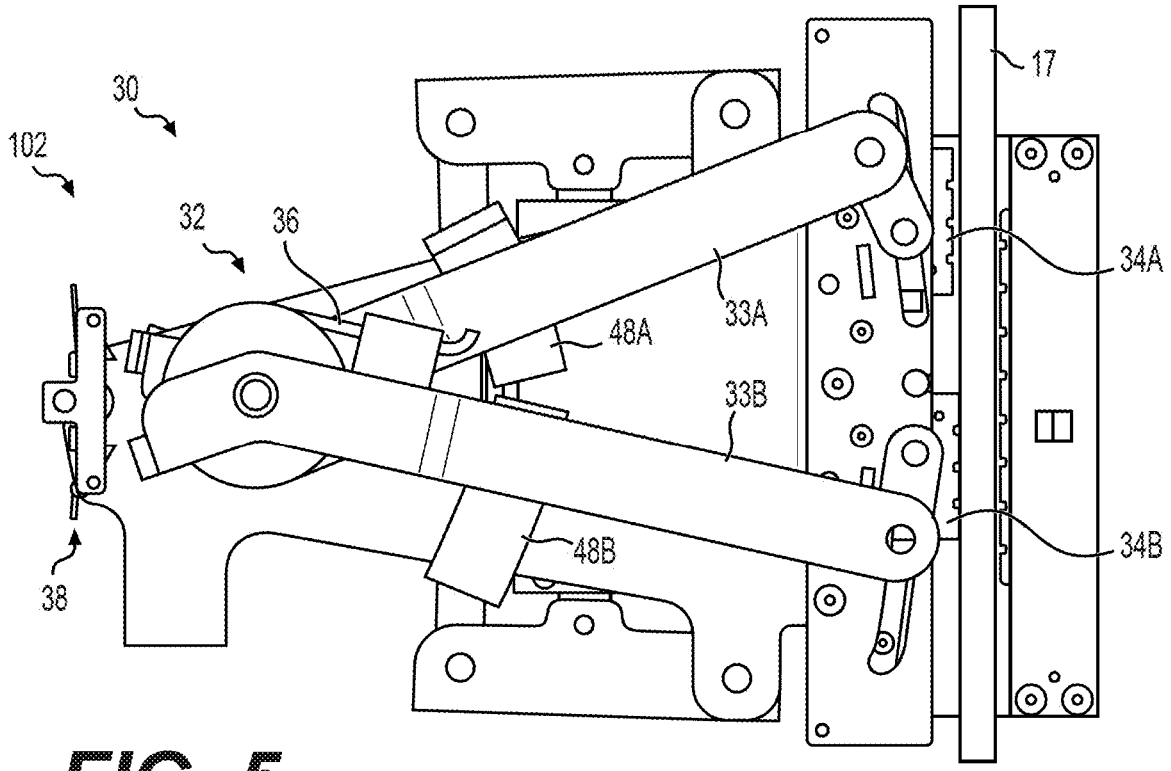
FIG. 5 illustrates schematically the safety gear arrangement according to the first embodiment of the present invention in its operated position from the first side.

FIG. 5 illustrates schematically the safety gear arrangement 30 according to the first embodiment of the present invention in its operated position 102 from the first side. FIG. 5 illustrates the operation when the gripping occurs when the elevator car 10 is moving downwards. As the safety gear arrangement 30 according to various embodiments may be bidirectional, the wedge portions 34A, 34B grip the guide rail 17 differently with respect to each other depending on the movement direction of the elevator car 10 as is known to a skilled person in the art.

Figure 6:
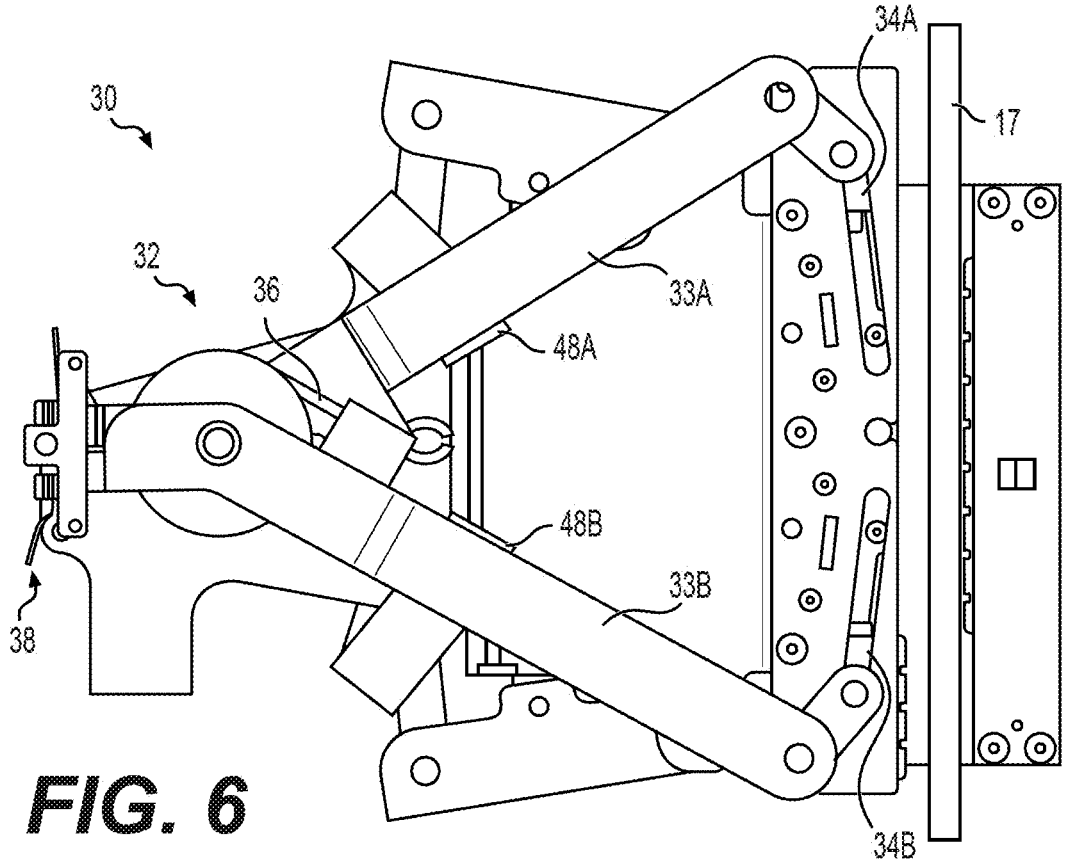
FIG. 6 illustrates schematically the safety gear arrangement according to the first embodiment of the present invention from the first side, wherein the safety gear arrangement is being moved to its normal position.

FIG. 6 illustrates schematically the safety gear arrangement 30 according to the first embodiment of the present invention from the first side, wherein the safety gear arrangement 30 is being moved to its normal position 101. This may be done manually, however, as described hereinabove, it may be implemented by the portions of the third support members 48A, 48B gripping the first support members 33A, 33B and, thereby drawing them apart against the force of the first spring element 36. Of course, the third support members 48A, 48B or other means could be utilized to push the first support members 33A, 33B as well. The movement of the third support members 48A, 48B may be implemented, for example, by the linear motor 50. As visible in FIG. 6, the locking mechanism 38 may substantially simultaneously, however, preferably slightly later be arranged to lock to first support members 33A, 33B to their positions corresponding to the normal position 101 of the arrangement 30.

Figure 7:
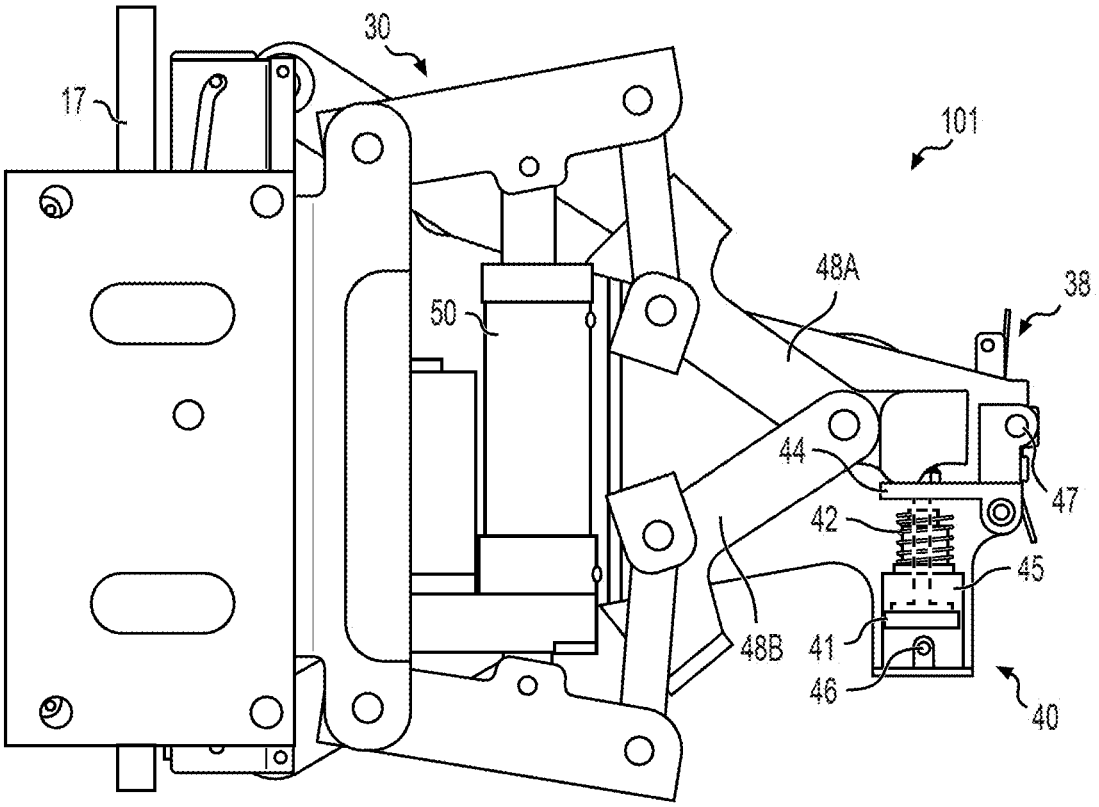
FIG. 7 illustrates schematically the safety gear arrangement according to the first embodiment of the present invention from the second side, wherein the actuating member is being moved to its untriggered position.

FIG. 7 illustrates schematically the safety gear arrangement 30 according to the first embodiment of the present invention from the second side, wherein the actuating member 44 is being moved to its untriggered position 111. As can be seen, the third support member 48A, or a portion thereof, pushes the actuating member 44 so that it becomes in contact with the electromagnet 41.

In various embodiments, the safety gear arrangement 30 may now be arranged to its normal position 101, however, in the first embodiment, the third support member 48A still needs to be moved away from the actuating member 44 so that it would not prevent the operation thereof. It is clear that this could be implemented in other ways as well, nevertheless, in the first embodiment, the linear motor 50 is utilized for this as shown in FIG. 8.

Figure 8:
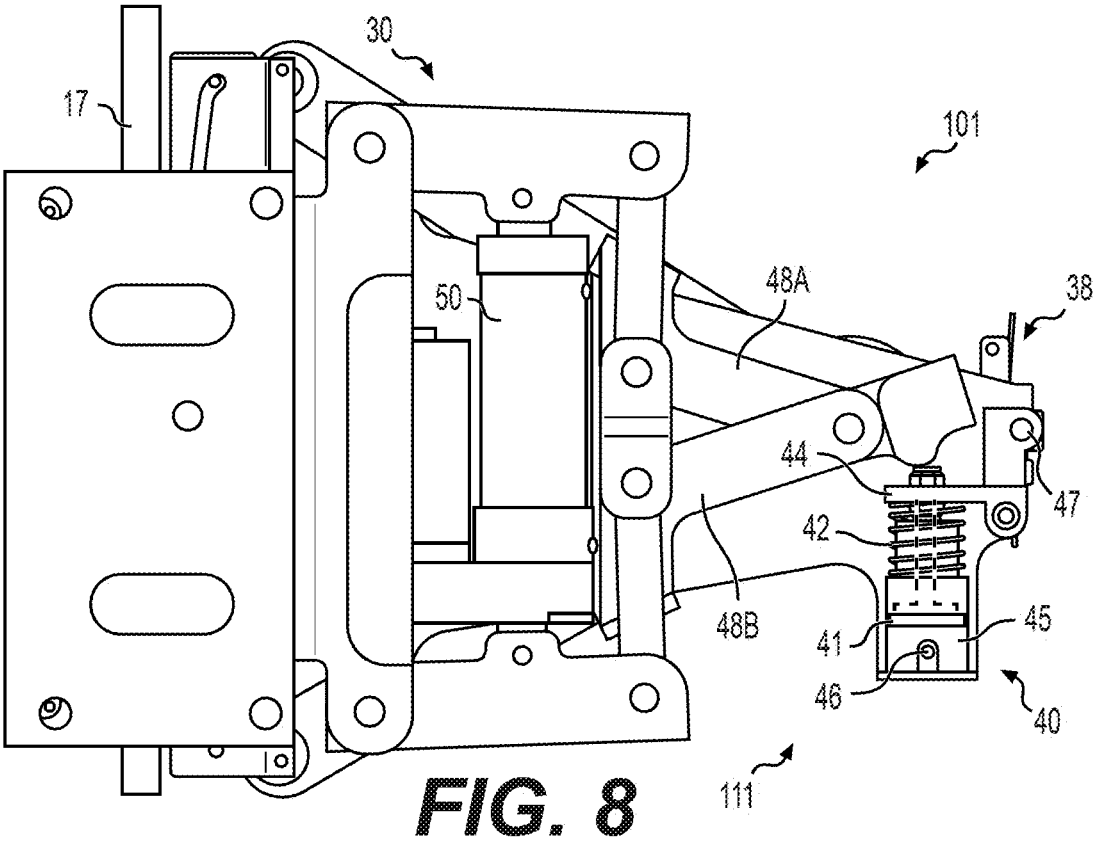
FIG. 8 illustrates schematically the safety gear arrangement according to the first embodiment of the present invention from the second side, wherein the actuating member is in its untriggered position and the safety gear arrangement in its normal position.

FIG. 8 illustrates schematically the safety gear arrangement 30 according to the first embodiment of the present invention from the second side, wherein the actuating member 44 is in its untriggered position 111 and the safety gear arrangement 30 in its normal position 101. As can be seen in FIG. 8, there is a small gap between the portion of the third support member 48A and the actuating member 44 thus allowing, if triggered, movement of the actuating member 44 freely relative to the portion of the third support member 48A.

Figure 9A:
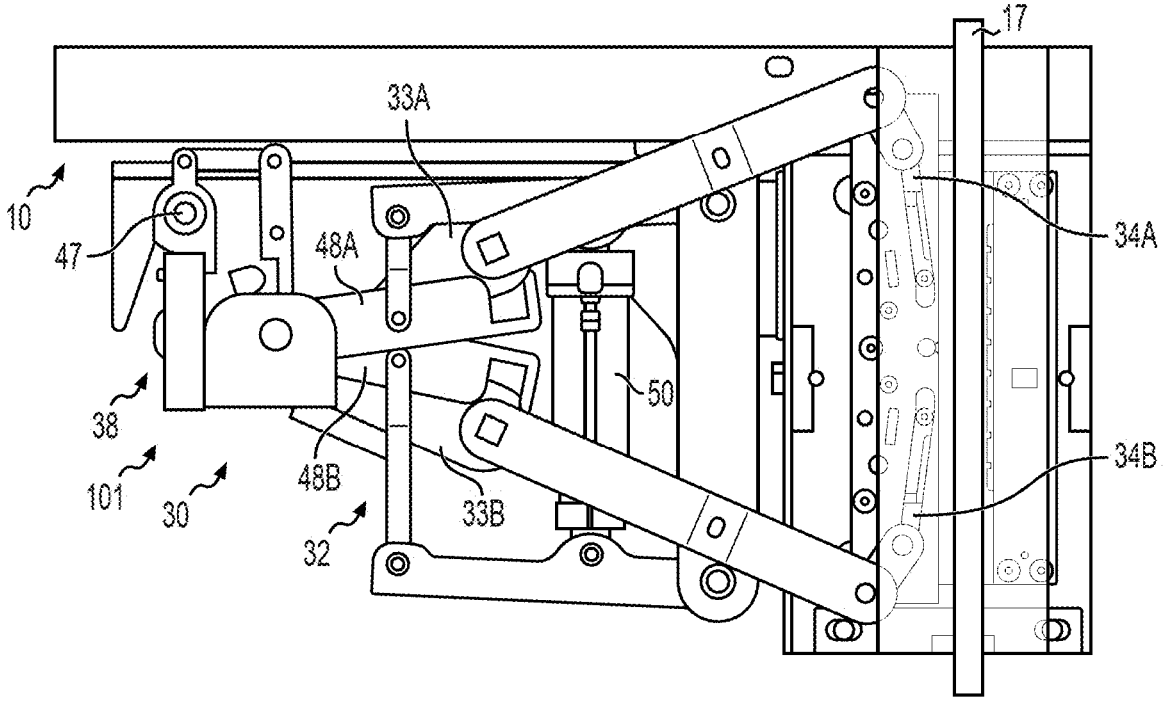
FIGS. 9A and 9B illustrate schematically the safety gear arrangement according to a second embodiment of the present invention in its normal position from opposite sides, that is from a first side and a second side, respectively.
Figure 9B:
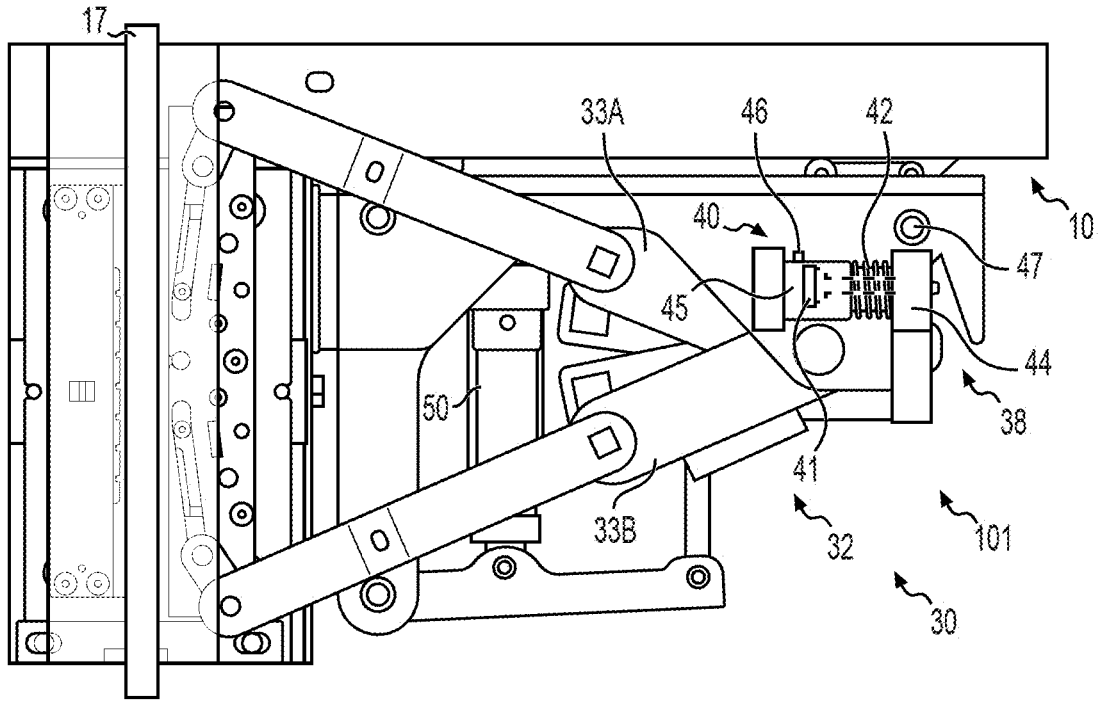

FIGS. 9A and 9B illustrate schematically the safety gear arrangement 30 according to a second embodiment of the present invention in its normal position 101 from opposite sides, that is from a first side and a second side, respectively. As with the first embodiment, the safety gear arrangement 30 may comprise a safety gear mechanism 32 comprising at least one wedge portion 34A, 34B of the safety gear arrangement 30, wherein, in a normal position 101, the at least one wedge portion 34A, 34B is retracted and, in an operated position 102 (not shown in FIGS. 9A and 9B), extended by a first spring element (not shown) for acting on a guide rail 17 of the elevator system 100. Although shown in FIGS. 9A and 9B that there are two wedge portions 34A, 34B, in some embodiments, there could only be one wedge portion 34A, 34B or more than two wedge portions 34A, 34B.

Furthermore, regarding FIG. 9B, the safety gear arrangement 30 may comprise a triggering device 40 comprising an electromagnet 41, such as arranged inside the body 45 of the device 40, a second spring element 42, such as a compression spring element, an actuating member 44 (the portion extending inside the body 45 is shown with dashed lines), and an excitation power input 46, wherein the electromagnet 41 is arranged, while being supplied with excitation power via the excitation power input 46, to maintain the actuating member 44 in an untriggered position 111 against the second spring element 42. The actuating member 44 may be arranged to operate the safety gear mechanism 32 in response to moving of the actuating member 44 from the untriggered position 111 to a triggered position (not shown in FIGS. 9A and 9B) due to the second spring element 42, such as when the excitation power is being cut off or interrupted. This will cause the at least one wedge portion 34 to move to its operated position 102, and thereby, if the safety gear arrangement 30 has been arranged to an elevator system 100 appropriately and configured for operation, towards the guide rail 17 or other gripping surface. The safety gear arrangement 30 may further comprise a frame to which at least some of its components may be mounted (those requiring said mounting) and by which the arrangement 30 may be mounted to the elevator car 10.

As can be seen in FIGS. 9A and 9B, there are wedge portions 34A, 34B on both sides of the arrangement 30. It should be noted, however, that there may be only one or one set of wedge portions 34A, 34B only on one side of the arrangement 30, such as in the first embodiment. On the other hand, in the first embodiment, there could also be wedge portions 34A, 34B on both sides of the arrangement 30. This is further described in connection with FIG. 15.

In various embodiments, the actuating member 44 may comprise a single part or be comprised of several parts which are mechanically connected to each other. In FIG. 9B, for example, the actuating member 44 comprises essentially two parts, the one mostly inside the body 45, such as a spindle or shaft, and the vertical element to which the part mostly inside the body 45 is attached to. Thus, the second spring element 42 may also be arranged to apply force on the actuating member 44, such as to said vertical element in FIG. 9B which may be part of the actuating member 44. It is to be noted, however, that the actuating member 44 could also be made essentially of a single part.

In addition, the safety gear arrangement 30 may comprise a locking mechanism 38 in operative, preferably mechanical, coupling with the actuating member 44, wherein the locking mechanism 38 is arranged to maintain the safety gear mechanism 32 in the normal position 101 when the actuating member 44 is in the untriggered position 111, and to release the safety gear mechanism 32 when actuating member 44 is in the triggered position so that the first spring element 36 causes the moving of the at least one wedge portion 34A, 34B.

In some embodiments, the safety gear mechanism 32 may comprise at least one first support member 33A, 33B mechanically coupling the locking mechanism 38 and the wedge portion 34A, 34B.

Alternatively or in addition, the safety gear mechanism 32 may comprise two wedge portions 34A, 34B, such as shown in FIGS. 9A and 9B, wherein, in the normal position 101, the wedge portions 34A, 34B are retracted and, in the operated position 102, extended for acting, for example, on the guide rail 17 of the elevator system 100. Optionally, the safety gear mechanism 30 may, in addition, comprise one of the first support members 33A mechanically coupling the locking mechanism 38 and one of the wedge portions 34A, and other one of the first support members 33B mechanically coupling the locking mechanism 38 and other one of the wedge portions 34B.

Still further, the safety gear mechanism 32 may comprise the first support members 33A, 33B operatively coupled by a joint with respect to each other.

In still other embodiments, there may be one or set of wedge portions 34A, 34B on either side of the safety gear triggering device 40.

Furthermore, alternatively or in addition, the first support member(s) 33A, 33B may extend between the locking mechanism 38 and one of the wedge portion(s) 34A, 34B. Thus, the first support member(s) 33A, 33B may be a one-piece element or elements, or, alternatively, may be comprised of a plurality of elements, such as will be illustrated in FIG. 15.

In various embodiments, such as shown in FIGS. 9A and 9B, the safety gear arrangement 30 may comprise a linear motor 50, wherein the linear motor 50 is arranged to move the safety gear mechanism 30 from the operated position 102 to the normal position 101. Furthermore, the triggering device 40 may be arranged to move from the triggered position to the untriggered position 111 in response to the movement of the safety gear mechanism 32 from the operated position 102 to the normal position 101.

In some embodiments, such as shown in FIGS. 9A and 9B, in the untriggered position 111, the actuating member 44 and the electromagnet 41 are in direct contact with each other, such as there is no air gap between them. This is visible in FIG. 9B in which the portion of the actuating member 44 inside the body 45 is essentially in contact with the electromagnet 41. It is clear, however, there may also be intermediate layers arranged between the actuating member 44 and the electromagnet 41, such as of magnetic material. Thus, the electromagnet 41 can be utilized to maintain the actuating member 44 in its untriggered position 111 against the force of the second spring element 42. In various embodiments, the electromagnet 41 may, advantageously, be designed, such as dimensioned, so that it can generate enough force to maintain the actuating member 44 in its position, however, not necessarily able to move the actuating member 44 from the triggered position to the untriggered position 111.

Optionally, there may be a second support member 47 mechanically coupling the actuating member 44 and the locking mechanism 38 to each other. In FIG. 9B, this may be an axis of a joint connecting the locking mechanism 38 and the actuating member 44.

In some embodiments, the safety gear arrangement 30 may comprise at least one third support member 48A, 48B mechanically coupling, or at least be involved in the operative, preferably mechanical, coupling of, the actuating member 44 and the linear motor 50. By said operative, preferably mechanical, coupling, the actuating member 44 is configured to be moved to the untriggered position 111. Thus, said operative coupling does not necessarily, as will be shown, exists in all positions of the safety gear arrangement 30.

In various embodiments, the locking mechanism 38 may arranged to lock the safety gear mechanism 32 in response to moving of the safety gear mechanism 32 from the operated position 102 into the normal position 101. In embodiments in accordance with FIG. 2B, for example, this is implemented so that the linear motor 50 moves the third support member(s) 48A, 48B which, as better shown in FIG. 2A, move the first support members 33A, 33B away from each other with a gripping portion(s) thereof, such as a flange(s), and then by also moving the actuating member 44, arranges the locking mechanism 38 to lock the safety gear mechanism 32. This will be described in more detail hereinafter.

In FIGS. 9A and 9B, the actuating member 44 may act also as a part of the locking mechanism 38. Once the triggering device 40 is being operated, that is moved from the untriggered position 111 to the triggered position 112, the actuating member 44 moves away from the ends of first support members 33A, 33B, thereby releasing them. This is further illustrated in FIG. 10.

Figure 10:
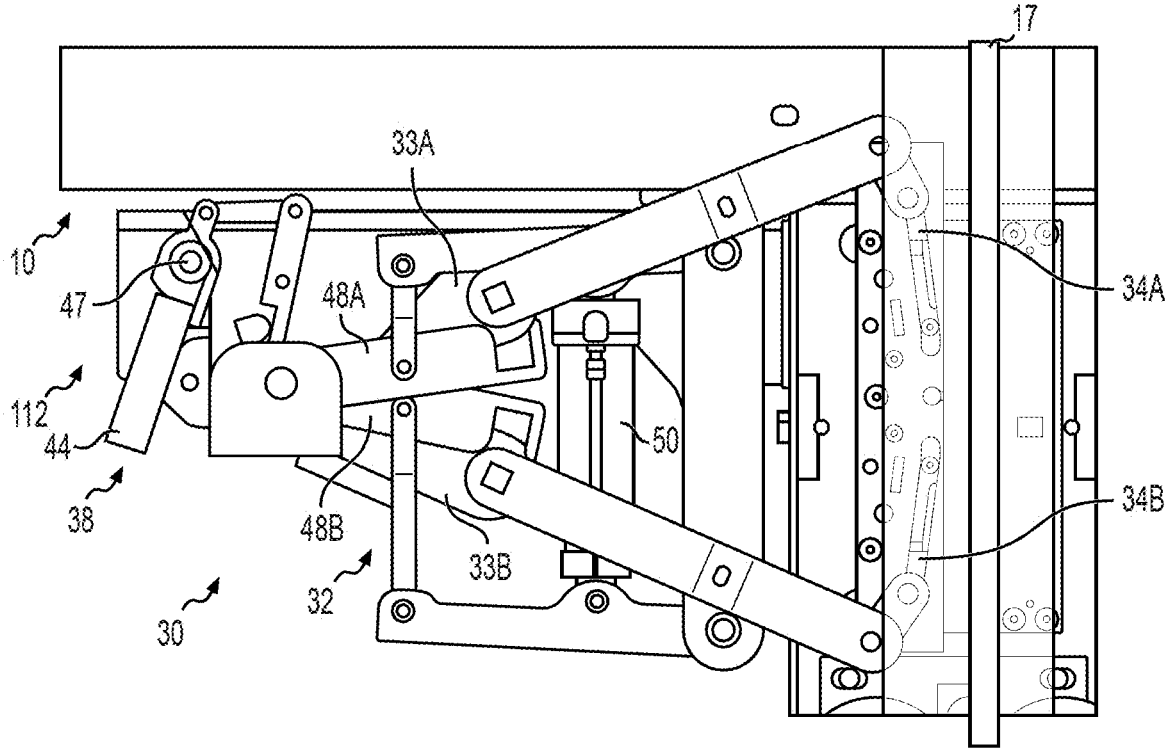
FIG. 10 illustrates schematically the safety gear arrangement according to the second embodiment of the present invention from the first side, wherein the actuating member is in its triggered position.

FIG. 10 illustrates schematically the safety gear arrangement 30 according to the second embodiment of the present invention from the first side, wherein the actuating member 44 is in its triggered position 112. As can be seen, the movement of the actuating member 44 causes releasing of the first support members 33A, 33B from the normal position 101.

Figure 11:
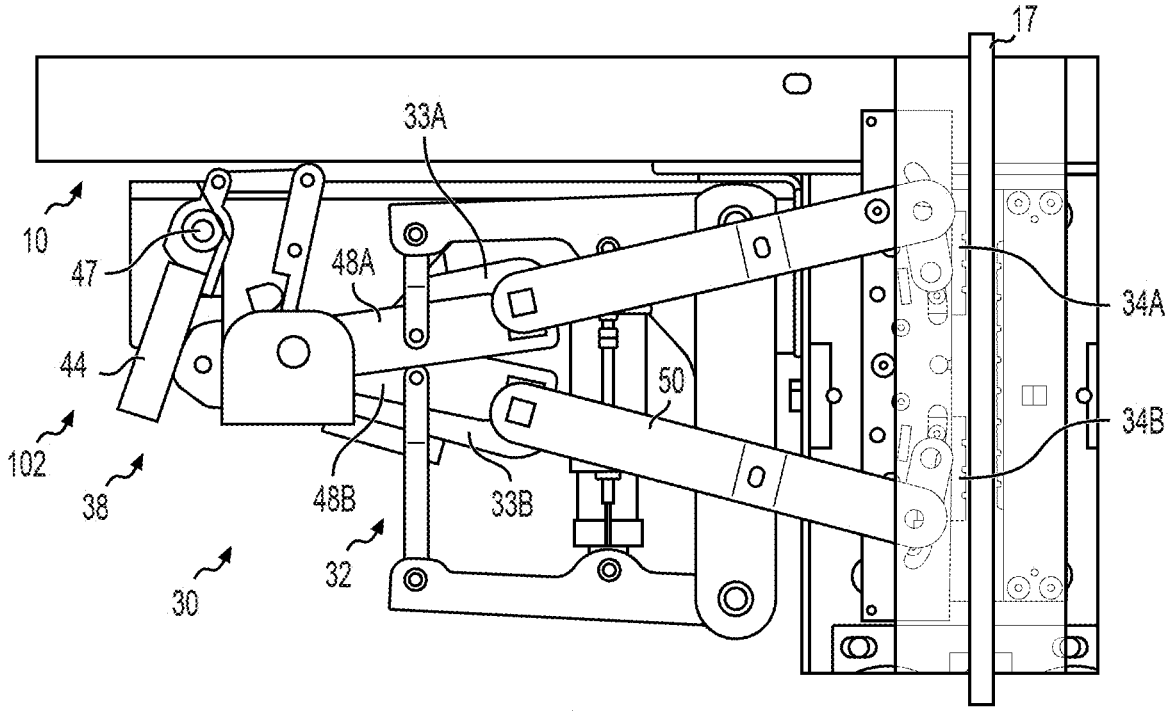
FIG. 11 illustrates schematically the safety gear arrangement according to the second embodiment of the present invention in its operated position from the first side.

FIG. 11 illustrates schematically the safety gear arrangement 30 according to the second embodiment of the present invention in its operated position 102 from the first side. As can be seen, the wedge portions 34 are extended by a first spring element, such as a torsion spring element, for acting on the guide rail 17 of the elevator system 100.

Figure 12:
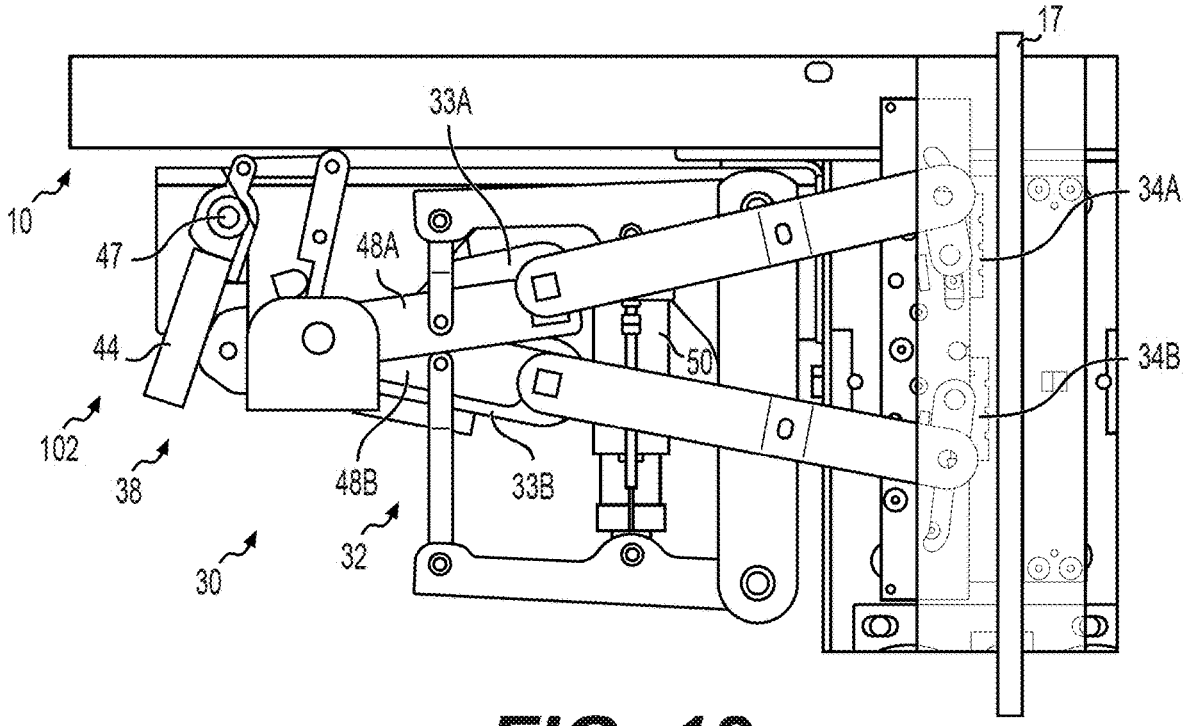
FIG. 12 illustrates schematically the safety gear arrangement according to the second embodiment of the present invention from the first side, wherein the actuating member is in its triggered position.

FIG. 12 illustrates schematically the safety gear arrangement 30 according to the second embodiment of the present invention in its operated position 102 from the first side. FIG. 12 illustrates the operation when the gripping occurs when the elevator car 10 is moving downwards. As the safety gear arrangement 30 according to various embodiments may be bidirectional, the wedge portions 34A, 34B grip the guide rail 17 differently with respect to each other depending on the movement direction of the elevator car 10 as is known to a skilled person in the art.

Figure 13:
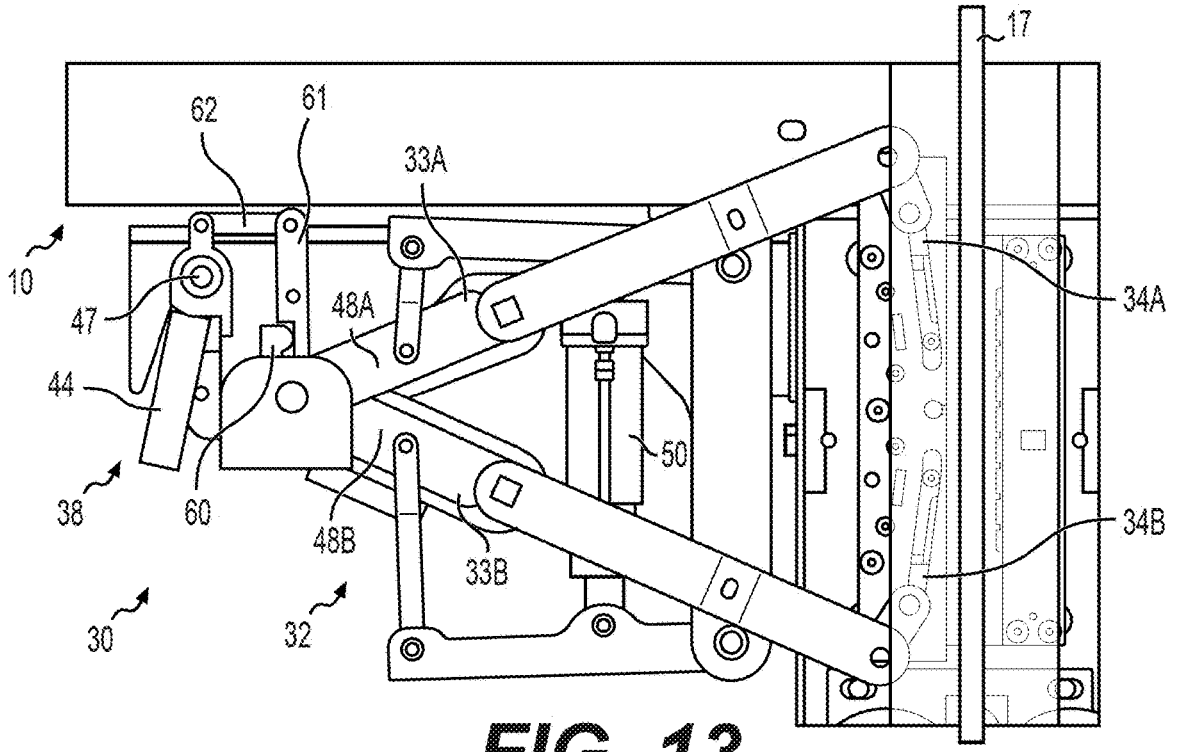
FIG. 13 illustrates schematically the safety gear arrangement according to the second embodiment of the present invention from the first side, wherein the safety gear arrangement is being moved to its normal position.

FIG. 13 illustrates schematically the safety gear arrangement 30 according to the second embodiment of the present invention from the first side, wherein the safety gear arrangement 30 is being moved to its normal position 101. This may be done manually, however, as described hereinabove, it may be implemented by the portions of the third support members 48A, 48B are gripping the first support members 33A, 33B and, thereby drawing or pushing them apart against the force of the first spring element. The movement of the third support members 48A, 48B may be implemented, for example, by the linear motor 50. As visible in FIG. 13, the locking mechanism 38 may substantially simultaneously, however, preferably slightly later be arranged to lock to first support members 33A, 33B to their positions corresponding to the normal position 101 of the arrangement 30.

In various embodiments, the moving of the safety gear arrangement 30 to its normal position 101 may include utilizing reset members 61, 62 such as shown in FIG. 13. Element 60, which may be an integral portion of one of the first support members 33A, 33B, or may be a separate element which is arranged to move in response to the moving of one of the first support members 33A, 33B, may be arranged to move the first reset member 61 as visible from FIGS. 12 and 13. The first reset member 61 then moves the second reset member 62 which is pivotally coupled to the first reset member 61 and the second support member 47, or at least the element in connection with the second support member 47.

Thus, the actuating member 44 locks the first support members 33A, 33B. The actuating member 44 moves simultaneously in contact with the electromagnet 41 in the triggering device 40.

Figure 14:
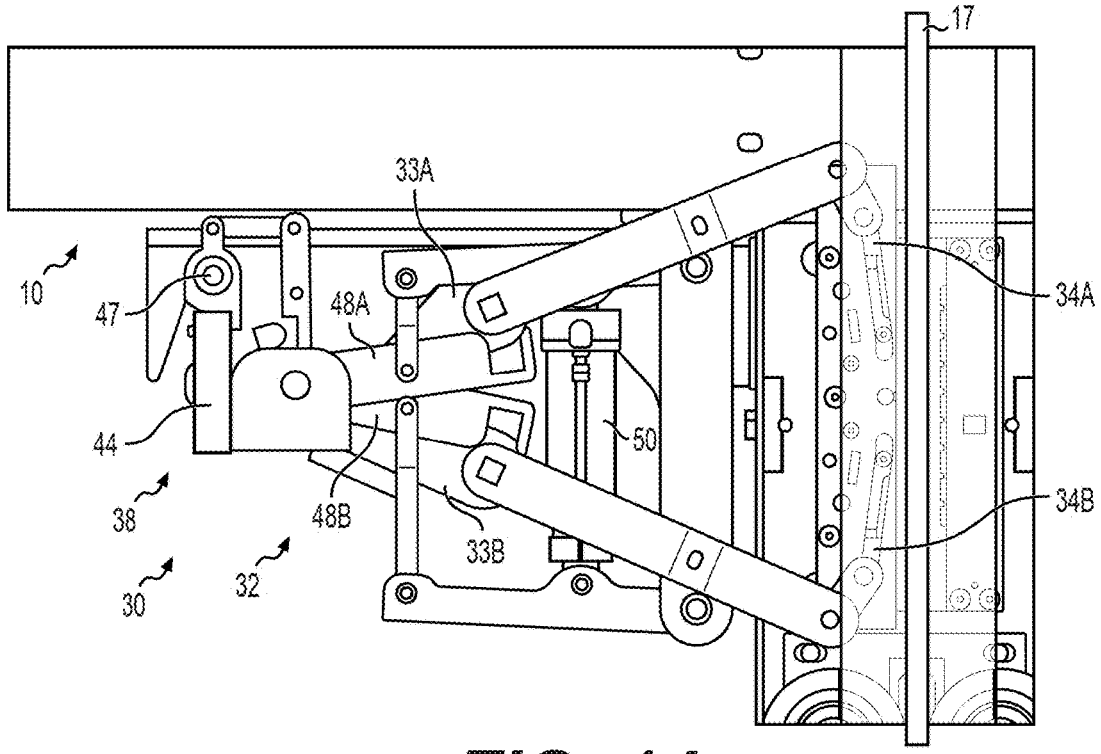
FIG. 14 illustrates schematically the safety gear arrangement according to the second embodiment of the present invention from the first side, wherein the actuating member is being moved to its untriggered position.

FIG. 14 illustrates schematically the safety gear arrangement 30 according to the second embodiment of the present invention from the first side, wherein the actuating member 44 is being moved to its untriggered position 111. The third support member 48A, or a portion thereof, moves the actuating member 44 so that it locks the first support members 33A, 33B in the normal position 101 by, e.g., catching the ends of the first support members 33A, 33B in a slot provided in the actuating member 44, simultaneously resetting the triggering device 40.

Then, as with the first embodiment, the electromagnet 41 may be excited and, thereby the actuating member 44 is kept in the untriggered position 111.

Figure 15:
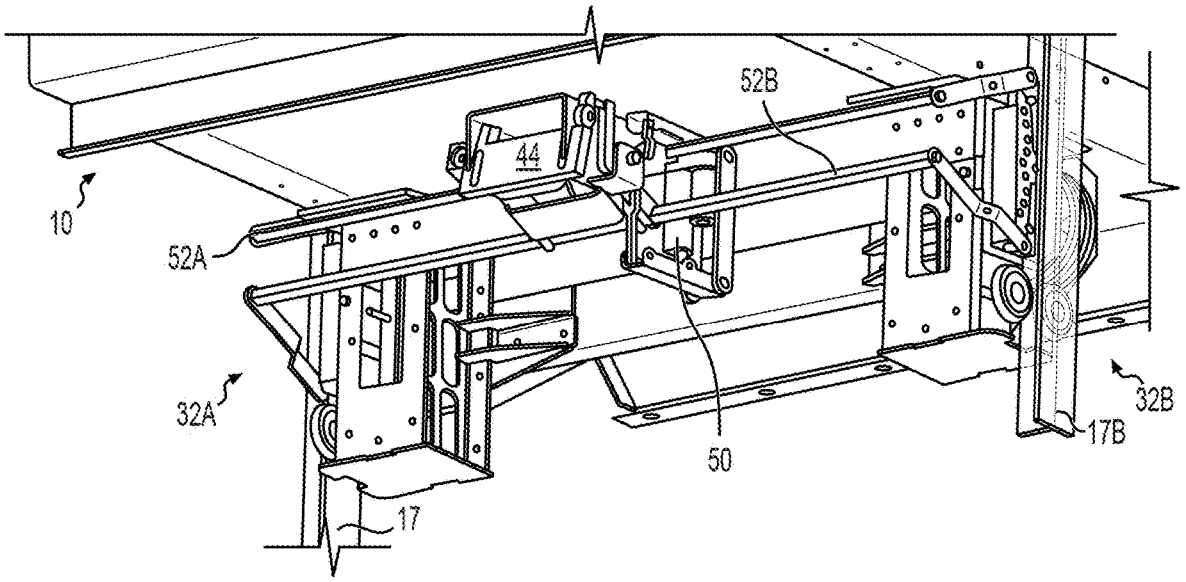
FIG. 15 illustrates schematically the safety gear arrangement according to an embodiment of the present invention.

FIG. 15 illustrates schematically the safety gear arrangement 30 according to an embodiment of the present invention. The safety gear arrangement 30 of FIG. 15 is similar to that of the second embodiment, however, it should be noted that it could as well be similar to that of the first embodiment. As can be seen, the safety gear arrangement 30 is mounted below an elevator car (shown on top of the figure).

In some embodiments, the safety gear arrangement 30 may, thus, comprise only one triggering device 40 which is arranged to operate one safety gear mechanism 32, and thereby one or many wedge portion(s) 34A, 34B, in connection with a guide rail 17, such as illustrated and described hereinbefore. On the other hand, the safety gear arrangement 30 may comprise only one triggering device 40 which is arranged to operate a plurality of safety gear mechanisms 32A, 32B, and thereby the wedge portion(s) 34A, 34B, in connection a plurality of guide rails 17, 17B, respectively, such as illustrated in FIG. 15.

Furthermore, in accordance with still another embodiments, there may be a plurality of triggering devices 40 arranged in connection with a plurality of safety gear mechanisms 32A, 32B, and thereby the wedge portion(s) 34A, 34B, in connection a plurality of guide rails 17, 17B, respectively. The safety gear arrangement 30 in accordance with said still another embodiments may further comprise a common controlling device or system (not shown) arranged in connection with each one of the excitation power inputs 46 of the plurality of triggering devices 40. Thus, the triggering devices 40 may be operated simultaneously by the common controlling device or system which may be arranged to interrupt the excitation power.

In various embodiments, the safety gear arrangement 30 comprises two safety gear mechanisms 32A, 32B, wherein a first safety gear mechanism 32A comprises the at least one wedge portion for acting on one guide rail 17 of the elevator system 100, and wherein a second safety gear mechanism 32B comprises at least one second wedge portion of the safety gear arrangement 30 for acting on another guide rail 17B of the elevator system 100, wherein the safety gear arrangement 30 further comprises the triggering device 40 arranged to operate the two safty gear mechanisms 32A, 32B in response to moving of the actuating member 44 from the untriggered position 111 to the triggered position 112 due to the second spring element 42. Thus, one triggering device 40 may be utilized to operate two safety gear mechanisms 32A, 32B, for example, on opposite sides of the elevator car 10.

As was described hereinbefore with respect to FIGS. 2A, 2B, 9A, and 9B, the first support members 33A, 33B may be a one-piece element or elements, or, alternatively, may be comprised of a plurality of elements. In FIG. 15, the first elements of the first support members 33A, 33B are arranged in closer to the triggering device 40 whereas the second portions which are coupled with the wedge portions 34A, 34B are arranged closer to the guide rail 17, 17B against which they are to be arranged with when the safety gear arrangement 30 is operated.

Thus, the two safety gear mechanisms 32 may be operatively coupled with the triggering device 40 by at least one fourth support member 52A, 52B, such as a bar or bars. Therefore, the fourth support member(s) 52A, 52B may be arranged at least between said first and second elements of the first support members 33A, 33B.

As visible in FIGS. 2A, 3-6, 9A-15, the wedge portions 34A, 34B may be arranged to move at least towards, or preferably in contact, with the guide rail(s) 17, 17B by a groove (or basically any inclined surface) which is unparallel with respect to the contact surface of the guide rail 17, 17B. The wedge portions 34A, 34B and/or the first support members 33A, 33B, or elements thereof, or other intermediate elements between the wedge portions 34A, 34B and triggering device 40, may be arranged to move along the groove or grooves, or the inclined surface(s) so that the wedge portions 34A, 34B move closer to the guide rail 17, 17B when the arrangement 30 is operated. It should be noted, however, that this is only one exemplary way to implement the movement of the wedge portions 34A, 34B towards the guide rail 17, 17B when the arrangement 30 is operated (and/or away from the guide rail 17, 17B when the arrangement 30 is moved from the operated position 102 back to the normal position 101).

Figure 16:
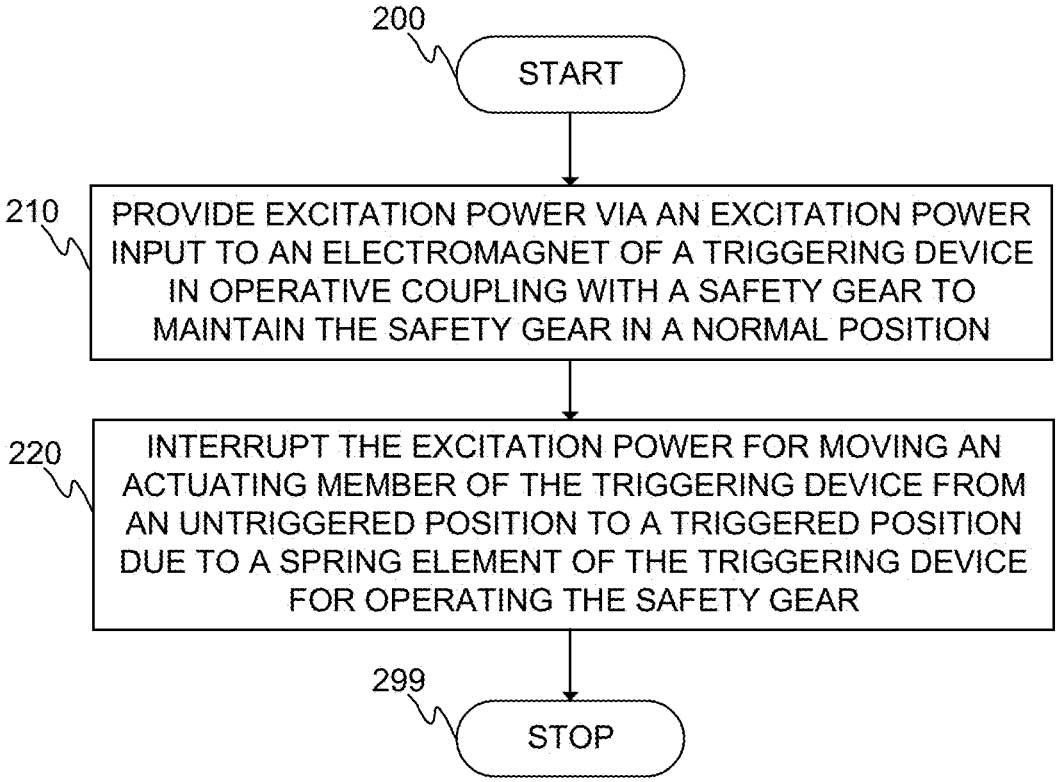
FIG. 16 shows a flow diagram of a method according to an embodiment of the present invention.

FIG. 16 shows a flow diagram of a method according to an embodiment of the present invention.

Step 200 refers to a start-up phase of the method. Suitable equipment and components are obtained and systems assembled and configured for operation.

Step 210 refers to providing excitation power via an excitation power input 46 to an electromagnet 41 of a triggering device 40 in operative coupling with the safety gear to maintain the safety gear in a normal position 101.

Step 220 refers to interrupting the excitation power for moving of an actuating member 44 of the triggering device 40 from the untriggered position 111 to a triggered position 112 due to a second spring element 42 of the triggering device 40 for operating the safety gear.

In some preferable embodiments, the method may further comprise, after said operation of the safety gear, arranging the safety gear, such as a safety gear arrangement in accordance with various embodiments described hereinbefore, from the operated position 102 to the normal position 101 by operating a motor, such as a linear motor, comprised in the safety gear arrangement 30. Optionally, said arranging may comprise arranging the triggering device 40 to move from the triggered position 112 to the untriggered position 111 in response to the arranging of the safety gear arrangement 40 from the operated position 102 to the normal position 101. The arranging of the triggering device 40 may also be performed by the motor. This may occur simultaneously with said arranging of the safety gear the operated position 102 to the normal position 101.

Method execution may be stopped at step 299.

In various embodiments of the method, the safety gear arrangement 30 in accordance with the first or the second embodiment as described hereinbefore may be utilized.

The invention claimed is:

1. A safety gear arrangement for an elevator system, the safety gear arrangement comprising:

a safety gear mechanism including two wedge portions, the safety gear mechanism configured to move between a normal position wherein the two wedge portions are in a retracted position, and an operated position wherein the two wedge portions are both moved toward a guide rail of the elevator system such that the two wedge portions are both moved to an extended position by a first spring element such that at least one wedge portion of the two wedge portions act on the guide rail of the elevator system; and a triggering device including and electromagnet, a second spring element, an actuating member, and an excitation power input, wherein the electromagnet is configured to maintain the actuating member in an untriggered position against the second spring element based on the electromagnet being supplied with excitation power via the excitation power input, wherein the actuating member is configured to operate the safety gear mechanism, to cause the safety gear mechanism to move from the normal position to the operated position, in response to movement of the actuating member from the untriggered position to a triggered position due to the second spring element; and wherein the safety gear mechanism further includes a locking mechanism in operative coupling with the actuating member, wherein the locking mechanism is configured to maintain the safety gear mechanism in the normal position based on the actuating member being in the untriggered position, and release the safety gear mechanism in response to the actuating member being in the triggered position, to enable the safety gear mechanism to move to the operated position such that the first spring element causes the movement of both of the two wedge portions towards the guide rail, wherein the safety gear mechanism further includes two first support members operatively coupled by a joint with respect to each other such that the two first support members are configured to pivot around the joint in relation to each other, the two first support members operatively coupling the locking mechanism and the two wedge portions, respectively, and wherein the safety gear arrangement is configured to operate such that, when the safety gear mechanism is moved to the operated position, the two wedge portions are both moved based on operation of the first spring element to be in contact with the guide rail of the elevator system, such that the two wedge portions are configured to grip the guide rail differently with respect to each other depending on a direction of movement of the safety gear mechanism relative to the guide rail so that the safety gear arrangement is configured to operate bidirectionally.

2. The safety gear arrangement of claim 1, further comprising:

a linear motor, wherein the linear motor is configured to move the safety gear mechanism from the operated position to the normal position.

3. The safety gear arrangement of claim 2, comprising at least one third support member operatively coupling the actuating member and the linear motor.

4. The safety gear arrangement of claim 1, wherein the triggering device is configured to move the actuating member from the triggered position to the untriggered position in response to movement of the safety gear mechanism from the operated position to the normal position.

5. The safety gear arrangement of claim 1, wherein, when the actuating member is in the untriggered position, the actuating member and the electromagnet are in direct contact.

6. The safety gear arrangement of claim 1, wherein the locking mechanism is configured to lock the safety gear mechanism in response to movement of the safety gear arrangement from the operated position into the normal position.

7. The safety gear arrangement of claim 1, wherein the safety gear mechanism includes a first safety gear mechanism and a second safety gear mechanism, wherein the first safety gear mechanism includes the at least one wedge portion of the two wedge portions that is configured to act on the guide rail of the elevator system, and the second safety gear mechanism includes at least one second wedge portion of the two wedge portions, the at least one second wedge portion configured to act on another guide rail of the elevator system, wherein the triggering device is configured to operate the first safety gear mechanism and the second safety gear mechanism in response to the movement of the actuating member from the untriggered position to the triggered position due to the second spring element.

8. The safety gear arrangement of claim 7, wherein the first safety gear mechanism and the second safety gear mechanism are coupled mechanically with the triggering device by at least one fourth support member.

9. The safety gear arrangement of claim 8, wherein the at least one fourth support member is a bar.

10. An elevator system, comprising:

an elevator car movable in an elevator shaft; and the safety gear arrangement of claim 1, wherein the safety gear arrangement is mounted on the elevator car.

11. A method for operating the safety gear arrangement of claim 1, the method comprising:

providing excitation power via the excitation power input to the electromagnet of the triggering device in the operative coupling with the safety gear mechanism to maintain the safety gear mechanism in the normal position; and interrupting the excitation power to cause the actuating member of the triggering device to move from the untriggered position to the triggered position due to the second spring element of the triggering device to cause the safety gear mechanism to move from the normal position to the operated position.

12. The safety gear arrangement of claim 1, wherein the first spring element is a torsion spring element.

13. The safety gear arrangement of claim 1, wherein the second spring element is a compression spring element.

* * * * *